United States Patent [19]

Goerke et al.

[11] 4,008,805

[45] Feb. 22, 1977

[54] APPARATUS AND METHOD FOR SORTING OBJECTS ACCORDING TO LENGTH

[76] Inventors: Paul Goerke, 14126 Dearborn, Riverdale, Ill. 60627; Waldemar S. Dyhringer, 257 E. 143rd St., Dolton, Ill. 60619

[22] Filed: June 9, 1975

[21] Appl. No.: 585,357

[52] U.S. Cl. ..... 209/73; 209/90

[51] Int. Cl.[2] ..... B07C 1/10

[58] Field of Search ..... 209/73, 74, 82, 90, 209/91

[56] References Cited

UNITED STATES PATENTS

| | | | |
|---|---|---|---|
| 2,355,311 | 8/1944 | Linkner | 209/90 |
| 3,498,452 | 3/1970 | Aronstein et al. | 209/90 X |

*Primary Examiner*—Allen N. Knowles

*Attorney, Agent, or Firm*—Frank J. Uxa

[57] ABSTRACT

An apparatus for segregating or separating elongated objects, e.g., nails, screws, rivets and the like, according to length comprises a rotatable disc; an elongated object inlet to supply elongated objects to the disc; at least one magnet to pick up and hold at least one elongated object from this inlet; a slanted plane located below the disc to provide a substantially constant predetermined length below the disc of elongated objects; and a plurality of exit means to remove and recover the elongated objects from the magnet.

An improved method for segregating elongated objects according to length has also been discovered.

13 Claims, 5 Drawing Figures

APPARATUS AND METHOD FOR SORTING OBJECTS ACCORDING TO LENGTH

This invention relates to an improved apparatus and method for segregating elongated objects. More particularly, this invention relates to an improved apparatus and method for segregating or separating elongated objects, e.g., nails, screws, rivets and the like, according to length.

In many instances in industry, elongated objects, e.g., nails, screws, rivets and the like, are used for specific purposes according to length. Quite frequently, for example, through inadvertance or mistake, such elongated objects of differing lengths are comingled. Such comingled masses of elongated objects often cannot be used as effectively and efficiently as if the elongated objects were segregated according to length. Thus, it would be advantageous to segregate or separate a mass of groups of elongated objects of differing lengths according to length.

Therefore, one object of the present invention is to provide an improved apparatus for segregating (or separating) comingled elongated objects of differing lengths according to length.

Another object of the present invention is to provide an improved method for segregating (or separating) comingled elongated objects of differing lengths according to length. Other objects and advantages of the present invention will become apparent hereinafter.

An improved apparatus for segregating or separating elongated objects, e.g. nails, screws, rivets and the like, according to length has now been discovered. The present apparatus comprises a rotatable disc; object inlet means located adjacent to the perifery of the disc to supply elongated objects to the disc; at least one magnetic means located at or near the perifery of the disc so that, as the disc rotates, the magnetic means picks up and holds at least one elongated object from the object inlet means, the magnetic means holding the elongated objects in a substantially vertical position relative to the rotation of the disc; leveling means located below the disc to provide a substantially constant predetermined length (greater than zero) below the disc of the elongated objects being held by the magnetic means as the disc rotates past the leveling means; and a plurality of exit means to remove and recover the elongated objects from the magnetic means as the disc rotates, each exit means comprising removal means at least partially located at a predetermined height above the disc for removing the elongated objects from the magnetic means and a collection means for storing the elongated objects thus removed, provided that the predetermined height above the disc of each succeeding removal means decreases. An improved method for segregating or separating such elongated objects according to length has also been found.

The present apparatus and method provide an effective and efficient means for segregating elongated objects according to length. The present apparatus can be used to provide a broad segregation according to length or a very fine segregation according to length. For example, the present apparatus, in particular the exit means can be adjusted so that at least a portion of each removal means can be located at a predetermined height above the disc which is either very much greater or nearly the same as the predetermined height above the disc of the next succeeding removal means. Thus, the present apparatus is versatile, e.g., can be used to segregate a wide variety of elongated objects according to length, adjustable, e.g., as noted above, sturdy and durable, e.g., requiring only one movable part — the rotatable disc. The present invention provides for rapid and sure segregation of elongated objects according to length.

The final exit means acts to remove and recover elongated objects from the magnetic means which are too short to be removed and recovered by the next-to-final exit means. The elongated objects recovered by any of the exit means may be reprocessed using an apparatus according to the present invention with exit means and/or leveling means suitably adjusted to further segregate these elongated objects according to length. In this manner, as fine a segregation of elongated objects according to length can be achieved using an embodiment of the present apparatus which includes only a limited number, e.g., two, three or four, of exit means. Of course, a fine segregation of elongated objects according to length may be achieved by providing the present apparatus with as many exit means as desired.

Turning to the present apparatus in more detail, a rotatable disc is an essential component. The size, e.g., diameter, configuration and thickness, of this disc are not critical to the present invention. However, in a preferred embodiment, the disc has a maximum transverse dimension from one point on its periphery to another point on its periphery, e.g., diameter, length, width, diagonal and the like (but not including circumference), ranging from about 3 inches to about 120 inches or more, more preferably from about 6 inches to about 60 inches. Preferably, the disc is substantially circular in configuration, although square discs, rectangular discs, elliptical discs and the like can be used. The disc should have a thickness, preferably a substantially uniform thickness (at least at or near its periphery), less than the length of the shortest elongated object to be segregated. Disc thicknesses ranging from about ⅛ inch or less to about 2 inches or more are preferred, with thicknesses from about ¼ inch to about 2 inches being especially preferred. The disc may be constructed of any suitable material. Typical materials include wood, non-magnetic metals, ceramics, plastics, synthetic composition materials and the like. Preferably, the disc is essentially non-magnetic.

The speed of rotation of the disc is not critical to the present invention. However, in order to achieve optimal benefits, the disc should rotate so that the segregation of elongated objects can proceed rapidly without prematurely breaking the attractive bond between the elongated object and the magnetic means. Thus, in a preferred embodiment, the disc rotates at a speed in the range from about 0.1 revolution per minute (rpm) or less to about 200 rpm or more, preferably from about 1 rpm to about 100 rpm. The rotation of the disc can be powered using any conventional means well known in the art. For example, through a series of pulleys connected by belts, electrical or pneumatic energy consumed by a motor or driver can be converted to mechanical energy to provide rotation to the disc.

The object inlet means of the present apparatus is located adjacent to the periphery of the dics to supply elongated objects to the disc. The object inlet means can, for example, comprise a supply hopper means for storing elongated objects to be segregated and a chute means, such as that shown in U.S. Pat. No. 1,324,650, for transporting elongated objects from the supply hopper means to the disc.

In a preferred embodiment, each magnetic means, described in detail hereinafter, picks up and holds a single elongated object per revolution of the disc. Therefore, preferably the object inlet means supplies elongated objects to the disc spaced in a predetermined manner to allow each magnetic means to pick up and hold a single elongated object per revolution of the disc. Thus, the object inlet means preferably comprises a supply hopper means for storing elongated objects to be segregated; chute means for transporting elongated objects from the supply hopper means in a single file array to a supply means; supply means located at the termination of the chute means for isolating the next single elongated object to be picked up and held by a magnetic means; and pin means located on the disc, the number of pin means being equal to the number of magnetic means, whereby the supply means is mechanically responsive to the movement of the pin means as the disc rotates as that as the next elongated object, referred to above, is picked up and held by the magnetic means, the single elongated object nearest the termination of the chute means moves into the supply means. In this manner, elongated objects are supplied to the magnetic means on a one-by-one basis.

A further essential component of the present apparatus is at least one magnetic means located at or near the periphery of the disc. As the disc rotates, the magnetic means picks up and holds at least one elongated object from the object inlet means, described above. The magnetic means hold the elongated objects in a substantially vertical position relative to the rotation of the disc. The magnetic means may, for example, be one or a series of strips, preferably having a vertical dimension less than or essentially equal to the thickness of the disc, of magnetized material attached, e.g., adhesively, to the periphery of the disc. However, this embodiment may require the use of straightening means, preferably essentially non-magnetic, as part of or attached to the continuous strip to maintain the elongated objects in a substantially vertical position as the disc rotates by the leveling means to be described in detail hereinafter.

In one particularly preferred embodiment, the present magnetic means is embedded, e.g., notched, into the periphery of the disc. In this embodiment each magnetic means comprises an elongated rod of magnetized material having a length which is less than or essentially equal to the thickness of the disc. The disc is provided, e.g., by machining, with a notch or notches at or near its periphery, which notches run the entire thickness of the disc. These notches receive the rods of magnetized material. These rods are, of course, positioned in the notches so as to be able to pick up and hold elongated objects from the object inlet means. In this preferred embodiment, the notches can be provided so that the disc itself, i.e., the edges of the notches, further acts to maintain the elongated objects held by the rods in substantially vertical position. Further in this embodiment, it is preferred that only one elongated object per rod be picked up and held per revolution of the disc.

In an additional particularly preferred embodiment, the present apparatus comprises a plurality of magnetic means, e.g., magnetic rods embedded or notched in the disc. The specific number of magnetic means included in the present apparatus is not critical to the present invention and depends, for example, on the size and speed of rotation of the disc. Thus, in this embodiment, the number of magnetic means may preferably range from 2 to about 400 or more, more preferably from about 4 to about 200.

The magnetic means of the present apparatus may be made of any material or combination of materials which can be magnetized. Therefore, the specific magnetic material or materials used may be those which are conventional and well known in the art. Of course, the magnetic means must be constructed of such material(s) which is capable of picking up and holding the elongated objects to be segregated by the present apparatus. In one preferred embodiment, the magnetic means comprises a metal selected from the group consisting or iron, cobalt, nickel and mixtures thereof. Examples of such suitable metals include iron, carbon steel, silicon-iron (4% by weight of silicon and 95% by weight of iron); sendust (9% by weight of silicon, 5% by weight of aluminum and 85% by weight or iron), nickel-iron alloys (e.g., 45% by weight of nickel and 55% by weight of iron), iron-nickel-copper alloys, iron-nickel-molybdenum alloys, iron-nickel-chromium-copper alloys, iron-nickel-copper-molybdenum alloys, iron-cobalt alloys, iron-cobalt-vanadium alloys, iron-tungsten-manganese alloys (e.g., tungsten steel), iron-chromium-manganese alloys (e.g., KS magnet steel), iron-cobalt-chromium-manganese alloys (e.g., cobalt-chrome steel), iron-cobalt-molybdenum alloys, iron-cobalt-tungsten alloys, iron-nickel-aluminum alloys, iron-cobalt-nickel-aluminum-copper alloys (e.g., Alnico 2), iron cobalt-nickel-aluminum-titanium alloys, platinum-cobalt alloys, and the like. In a more preferred embodiment, the magnetic means comprises a major amount of iron, carbon steel and mixtures thereof.

The leveling means of the present apparatus is located below the disc to provide a substantially constant predetermined length below the disc of the elongated objects being held by the magnetic means as the disc rotates past the leveling means. In a preferred embodiment, the leveling means comprises an essentially stationary slanted plane situated below the disc so that the distance between the disc and slanted plane descreases in the direction of disc rotation. In this embodiment, the bottom end of the elongated object being held by the magnetic means comes in contact with the slanted plane at some point below the upper edge of the slanted plane. The combination of disc rotation and the slanted plane being stationary acts to push up the elongated object so that it can rotate by the upper edge of the slanted plane. The upper edge of the slanted plane is fixed at a substantially constant, predetermined distance below the disc. Thus, as each elongated object rotates past the upper edge of the slanted plane, a substantially constant, predetermined length of elongated object remains below the disc. Of course, in this embodiment it is essential that the elongated objects be situated on the magnetic means so that the objects come in contact with the slanted plane.

In a further preferred embodiment, the distance between the disc and the slanted plane, and/or the angle of incline of the slanted plane are adjustable to provide the present apparatus with greater flexibility, e.g., the ability to finely segregate elongated objects having widely varying lengths. Such adjustments can be made depending, for example, on the lengths of the individual elongated objects being segregated, on the exactness of the segregation desired and the like factors.

The present apparatus further includes a plurality of exit means to remove and recover the elongated objects from the magnetic means. Each exit means, comprises removal means, located at least partially at a predetermined, preferably adjustable, height above the disc, for removing the elongated objects which come in contact with a portion of the removal means above the disc from the magnetic means; and a collection means for storing the elongated objects thus removed, provided that the predetermined height above the disc of at least a portion of each succeeding or following (in the direction of disc rotation) removal means is decreased. In order to achieve the optimal benefits of the present invention, it is preferred that each removal means comprise an upper means and a bottom means. The bottom means, located below the disc, is situated so as to come into contact with each elongated object which passes as the disc rotates to remove the lower portion of each such elongated object from the magnetic means. The upper means, located at a predetermined, preferably adjustable, height above the disc, is substantially aligned with the bottom portion and acts to remove from the magnetic means the upper portion of each elongated object which comes into contact with such upper means. Thus, if the elongated objects come into contact substantially simultaneously with both the bottom means and the upper means of the removal means the elongated object will be totally removed from the magnetic means and passed to the collection means for storage. However, if the elongated object comes into contact only with the bottom portion, the full elongated object will return to the magnetic means as the disc continues rotating.

As noted above, it is preferred that the height of the portion of the removal means above the disc, e.g., upper means, be adjustable. This height adjustable feature of the present invention provides increased flexibility and effectiveness. For example, by adjusting the height above the disc of a portion of the removal means, the range of lengths of elongated objects which can be segregated can be widely varied. In addition, the "fineness" of the segregation desired can be varied.

In general, and except as otherwise provided for herein, the apparatus of the present invention may be fabricated from any suitable material or combination of materials of construction. The material of construction used for each component of the present apparatus may be dependent upon the particular application involved. Of course, the apparatus should be made of materials which are substantially unaffected, except for normal wear and tear, by the conditions at which the apparatus is normally operated. In addition, such material or materials should have no substantial detrimental effect on the elongated objects being segregated.

These and other aspects and advantages of the present invention are set forth in the following detailed description and claims, particularly when considered in conjunction with the accompanying drawings in which like parts bear like reference numerals. In the drawings:

Figure 1:
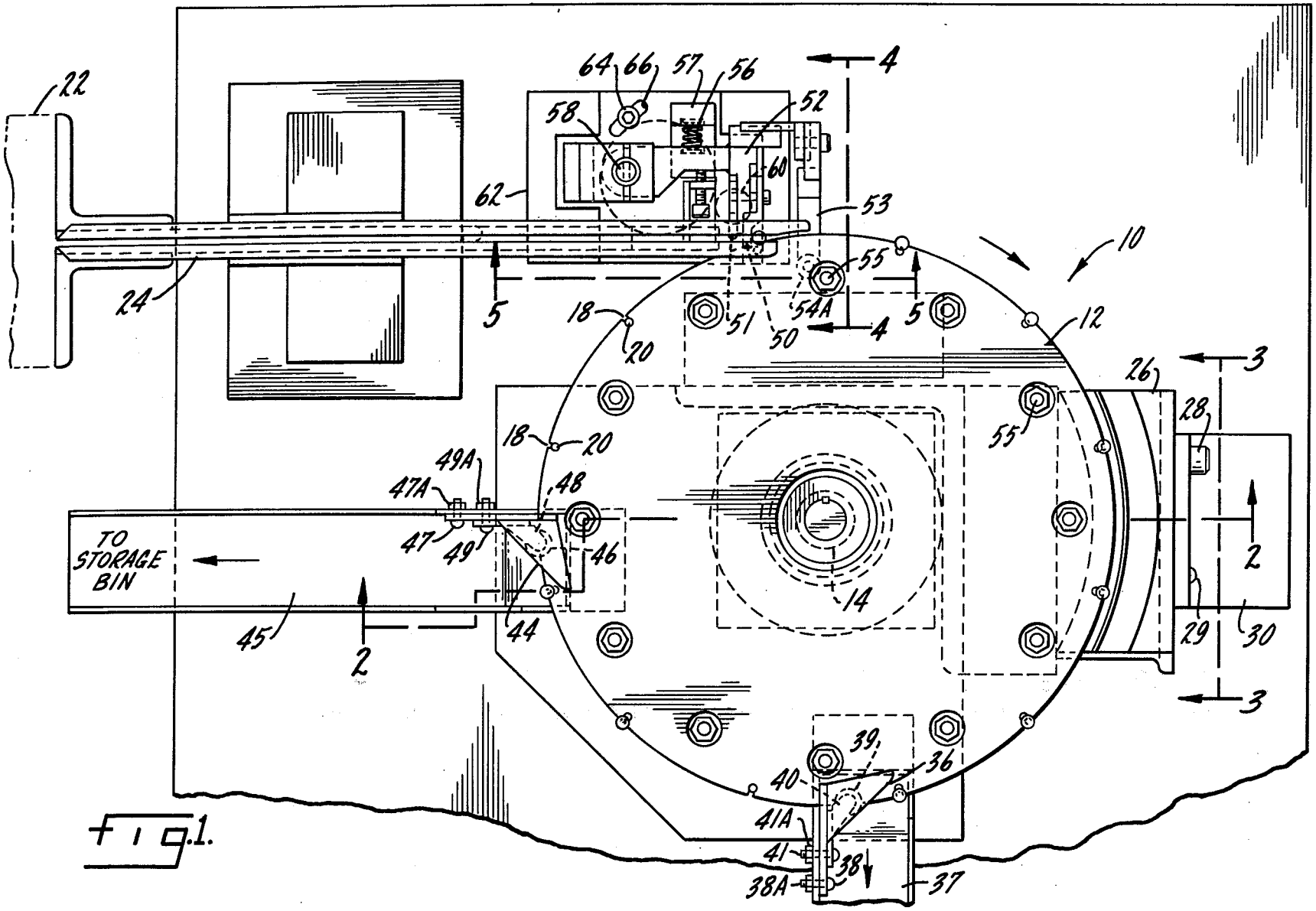
FIG. 1 is a top elevational view of one embodiment of the apparatus of the present invention.

Referring now to the drawings, the present apparatus, shown generally as 10, involves a rotatable disc 12 having a substantially uniform thickness. Rotatable disc 12 rotates in the direction shown in FIG. 1. As shown in FIG. 2, rotatable disc 12 is securely attached through its center to shaft 14 which rotates in response to variable speed motor 16. In this manner, disc 12 is rotated.

Rotatable disc 12 includes a series of notches 18 located at the perifery of disc 12. Wedged snugly within each of these notches 18 is a magnetic iron rod 20. Each of the notches 18 and magnetic iron rods 20 are essentially co-extensive with the thickness of disc 12.

Figure 2:
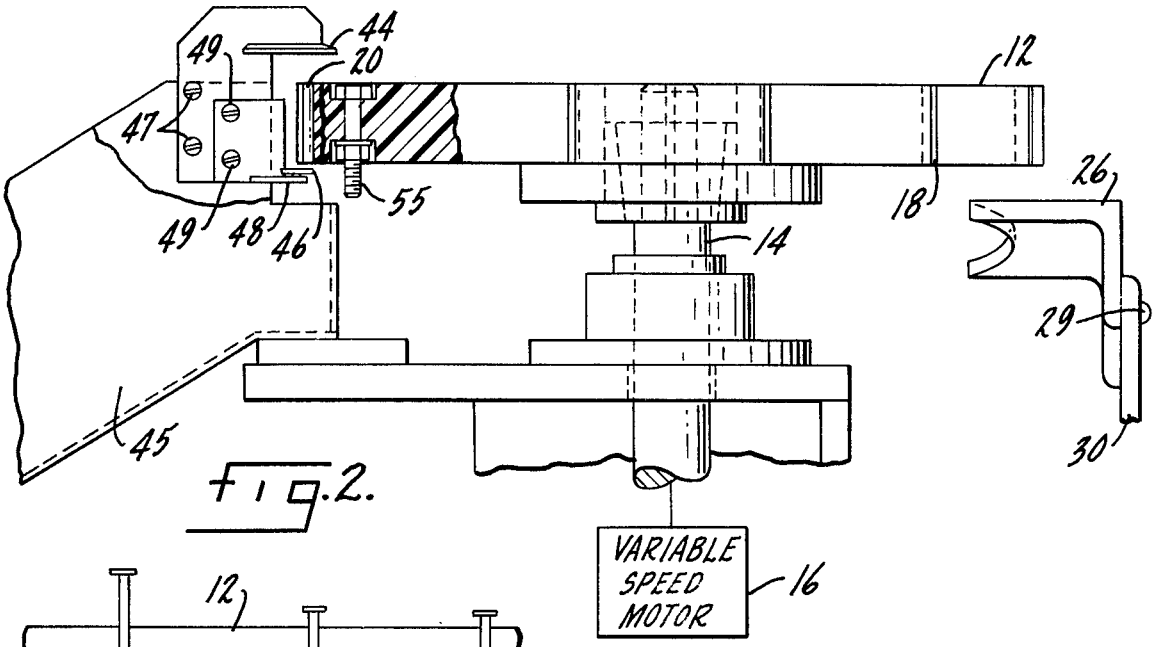
FIG. 2 is a side elevational view, partly in section, of the apparatus shown in FIG. 1 taken along line 2—2.

In the embodiment shown in FIG. 1, hopper 22 serves to store elongated objects to be segregated by the present apparatus. Inclined chute 24 transports the elongated objects in a single file array from hopper 22 to the proximity of the supply means, described in detail hereinafter. As disc 12 rotates, each magnetic iron rod 20 in the notch 18 acts to pick up (from the supply means) and hold a single elongated object in a substantially vertical position.

Figure 3:
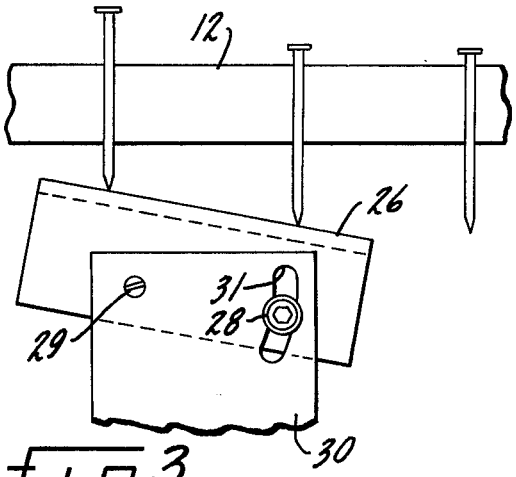
FIG. 3 is a partial side elevational view of the apparatus shown in FIG. 1 taken along line 3—3.
Figure 4:
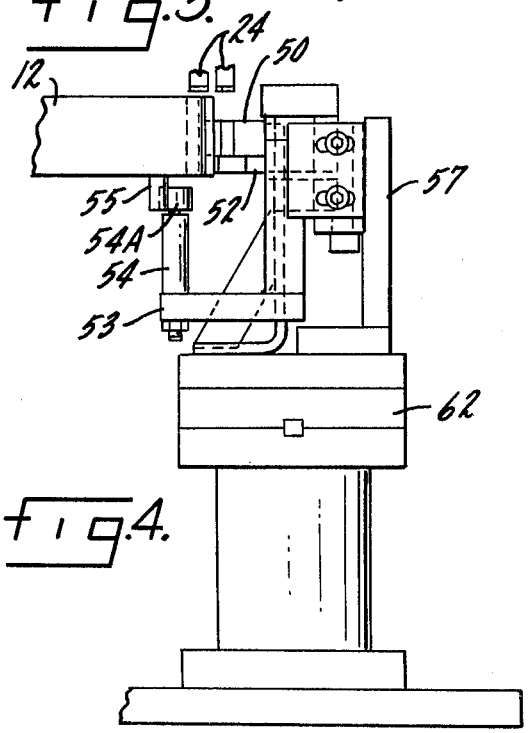
FIG. 4 is a side elevational view of the apparatus shown in FIG. 1 taken along line 4—4.
Figure 5:
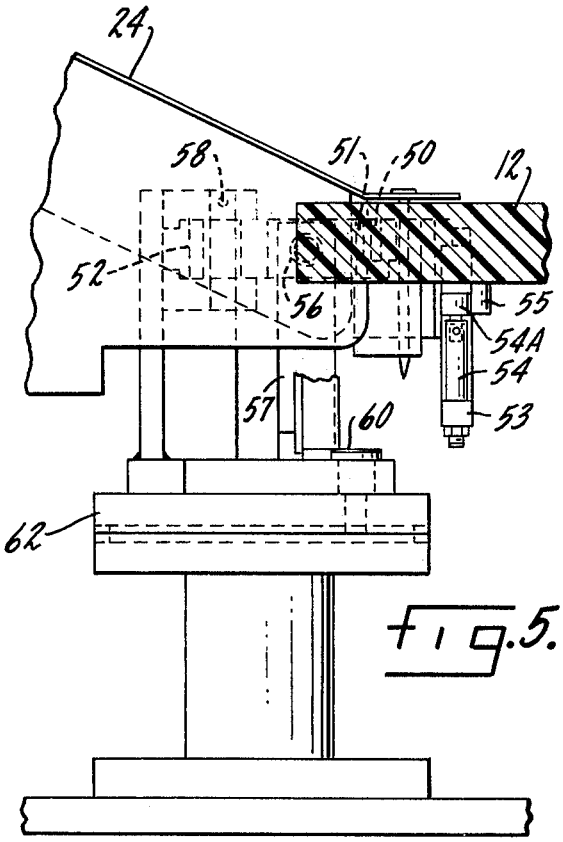
FIG. 5 is a side elevational view, partly in section, of the apparatus shown in FIG. 1 taken along line 5—5.

Adjustable plane 26 is connected, using bolt 28 to anchoring means 30 which, in turn, is securely attached to a stationary base (not shown). FIG. 3 also illustrates that the height and/or angle of incline of adjustable plane can be altered depending, for example, on the length and range of lengths of the elongated objects to be segregated. For example, bolt 28 can be loosened and the angle at which adjustable plane 26 is inclined to disc 12 can be changed by manipulating adjustable plane 26 around peg 29 which is attached to both adjustable plane 26 and anchoring means 30. When bolt 28 is again tightened to set the new angle of inclination between adjustable position relative to slot 31, thus reflecting the change in inclination angle. Adjustable plane 26 is situated so as to provide a constant predetermined length of elongated object below disc 12 as disc 12 rotates past adjustable plane 26. Thus, as can be seen in FIG. 3, adjustable plane 26 is slanted with the upper edge being the last to come into contact with the elongated objects as disc 12 rotates by. As the elongated objects, held by magnetic iron rods 20 in notches 18, come in contact with adjustable plane 26, they are pushed up so that as each of the elongated objects rotate past the upper edge of adjustable plane 26, an essentially constant, predetermined length of elongated object exists below disc 12.

As the elongated objects, e.g., nails, rotate, the longest among them come into contact with the first upper means 36. First upper means 36, is attached to the wall of slide 37 by means of bolts 38 and nuts 38A. First upper means 36 acts to remove the upper portion of the longest nails from the magnetic iron rods 20. First lower means 39 is associated with angle bracket 40 which, in turn is attached to the wall of slide 37 by bolts 41 and nuts 41A. First lower means 39 rotates around its axis and acts to remove the lower portions of all the nails from magnetic iron rods 20. Thus, first upper means 36 and first lower means 39 are aligned such that both the upper and lower portions of the longest nails are removed simultaneously from the magnetic iron rods 20 and are sent via slide 37 to a storage bin. The first lower means 39 comes in contact with all of the nails being held by magnetic iron rods 20. However, if first upper means 36 does not simultaneously come in contact with the same nail, the lower portion of the nail will return to the magnetic iron rod 20 as disc 12 rotates by.

The shorter elongated objects are removed and recovered by the magnetic iron rods 20 by the second exit means, wherein the second upper means 44 is located at a reduced height above the disc 12 relative to the height above the disc 12 of first upper means 36. Second upper means 44 is attached to the wall of slide 45 by means of bolts 47 and nuts 47A. Second upper means 44 acts to remove the upper portions of all the remaining nails from the magnetic iron rods 20. Second lower means 46 is associated with angle bracket 48 which, in turn, is attached to the wall of slide 45 by bolts 49 and nuts 49A. Second lower means 46 rotates around its axis and acts to remove the lower portions of all the remaining nails from the magnetic iron rods 20. Second upper means 44 and second lower means 46 are aligned such that both the upper and lower portions of all the remaining nails are removed simultaneously from the magnetic iron rods 20 and are sent via slide 45 to a storage bin. As disc 12 rotates on past second upper means 44 and second lower means 46, each magnetic iron rod 20 is available to pick up and hold another nail for segregation or separation according to length by the present apparatus.

The supply means, referred to previously, is a part of the object inlet means of the embodiment of the present apparatus illustrated in the drawings. The supply means acts to isolate the next single nail to be picked up and held by a magnetic iron rod 20 between front stop 50 and back stop 51.

Both front stop 50 and back stop 51 move in a generally back-and-forth manner across chute 24 in controlled response to the rotation of disc 12 as follows. Both front stop 50 and back stop 51 are machined to form integral parts of block 52. Securely attached to block 52 in a cross arm 53 which has a generally vertical extension 54. Rotatable disc 12 is equipped with a number of pins 55 equal to the number of magnetic iron rods 20. Each of the pins 55 projects a distance below the lower surface of disc 12. Extension 54 with roller 54A attached is situated so that it comes into contact with each pin 55 as the disc 12 rotates by.

Block 52 is also attached to one end of spring means 56. The other end of spring means 56 is attached to stationary base 57. Block 52 can pivot around hinge 58.

As the disc 12 rotates, pin 55 comes in contact with extension roller 54A and, thus, pushes extension 54 away from its path. As extension roller 54A is so pushed, block 52 pivots around hinge 58 in such a fashion as to compress spring means 56. This pivoting of block 52 also causes front stop 50 and back stop 51 to move from across the path of chute 24. This movement of front stop 50 and back stop 51 allows the single nail which had been isolated between front stop 50 and back stop 51 to proceed to the proximity of the periphery of disc 12 and be picked up and held by a magnetic iron means 20. In addition, this movement of front stop 50 and back stop 51 allows the next single nail at the termination of chute 24 to fall into the space where it can be isolated by both front stop 50 and back stop 51.

As the disc 12 continues to rotate, pin 55 loses contact with extension roller 54A. As this contact is lost, spring means 56 expands and causes block 52 to pivot around hinge 58 which, in turn, causes both front stop 50 and back stop 51 to move across the path of chute 24. The next single nail to be picked up and held by a magnetic iron rod 20 is thereby isolated between front stop 50 and back stop 51. This cycle is repeated as the next succeeding pin 55 comes in contact with extension roller 54A.

If desired, the position of the entire assembly involving block 52 and associated components can be adjusted around pivot 60, which is securely affixed to stationary base 62. This adjustment is facilitated by loosening screw 64 and moving block 52 and associated components so that the position of screw 64 in slot 66 is changed. The new desired position of block 57 and associated components can be set by tightening screw 64. The position of block 57 and associated components may be adjusted to accommodate specific elongated objects to be segregated using the present apparatus.

Rotatable disc 12 can, if desired, be removed and replaced by a rotatable disc having a different thickness. Such replacement may be made, for example, to accomodate elongated objects having different lengths. Such removal and replacement can be accomplished using removal means through the center of rotatable disc 12.

While the attached drawings specifically illustrate the segregation or separation of nails, the apparatus of the present invention may be used to segregate any mass of elongated objects according to length. However, such elongated objects should be constructed of such material as to be capable of being picked up and held by the magnetic means of the present apparatus. Such materials include, for exmaple, various metals such as iron and iron alloys. Many of the materials listed previously may be used in the construction of such nails, screws, rivets and the like. The present apparatus finds particular applicability to segregating nails, screws, rivets and the like according to length. The size and type of such nails, screws, rivets and the like are not critical to the present invention. For example, these objects can have lengths from less than about ¼ inch to lengths of about 12 inches or more, preferably from about ½ inch to about 8 inches in length. Such nails, screws, rivets and the like often include a head portion. This head portion may be of any suitable size or shape.

EXAMPLE

This example illustrates certain of the advantages of the methods of the present invention.

A mass of flat head iron nails is stored in a supply hopper 22 of the apparatus 10 shown in the attached drawings. This comingled mass of nails includes nails which are 3 inches long and nails which are 4 inches long. Disc 12 is 12 inches in diameter and 1¼ inch thick. Twelve magnetic iron rods 20 and twelve pins 55 are included on the disc 12. The upper edge of adjustable plane 26 is set at a distance one inch below the disc 12. Both first lower means 39 and second lower means 46 are situated one-half inch below the disc 12. First upper means 36 is situated so as to come into contact with nails on the magnetic iron rods 20 at a distance of one and one-half inches above the disc 12. Second upper means 44 is situated so as to come into contact with the ramaining iron rods 20 at a distance of one-half inch above the disc 12.

The variable speed motor 16 is activated so as to cause disc 12 to rotate at 60 rpm. Comingled nails from supply hopper 22 are caused to proceed down chute 24 toward the supply means, described previously. After 10 minutes of operation, in which time 7,200 nails are processed, the variable speed motor 16 was deactivated. It is determined that the storage bin associated with the first upper means 36 contained only 4 inch nails and the storage bin associated with the second upper means 44 contained only 3 inch nails.

Thus, the present apparatus and methods provide for effective and efficient segregation of elongated objects. As has been shown, the present apparatus is durable, reliable and, because it involves a minimum of moving parts, is easy to maintain. The present methods provide a rapid and sure way to segregate elongated objects according to length.

While this invention has been described with respect to various specific examples and embodiments, it is to be understood that the invention is not limited thereto and that it can be variously practiced within the scope of the following claims.

The embodiments of the invention in which an exclusive property or privilege is claimed are defined as follows:

1. A apparatus to segregate elongated objects according to length comprising:

a rotatable disc;

object inlet means located adjacent to the periphery of said disc to supply elongated objects to said disc;

at least one magnetic means at or near the periphery of said disc so that, as said disc rotates, said magnetic means picks up and hold at least one elongated object from said object inlet means, said magnetic means holding said elongated objects in a substantially vertical position relative to the rotation of said disc;

substantially stationary leveling means located below said disc to contact said elongated objects being held by said magnetic means below said disc and to provide a substantially constant predetermined length below said disc of said elongated objects being held by said magnetic means as said disc rotates past said leveling means; and a plurality of exit means to remove and recover said elongated objects from said magnetic means as said disc rotates, each such exit means comprising removal means at least partially located at a predetermined height above said disc for removing said elongated objects from said magnetic means and a collection means for storing said elongated objects thus removed, provided that the predetermined height above said disc of each succeeding removal means decreases.

2. The apparatus of claim 1 wherein at least one of said removal means further comprises bottom means located below said disc and situated so as to come into contact with each said elongated object which passes as said disc rotates to remove the lower portion of each such elongated object from said magnetic means, whereby said elongated objects which simultaneously contact both said bottom means and said portion of said removal means located at a predetermined height above said disc are totally removed from said magnetic means.

3. The apparatus of claim 1 which comprises a plurality of said magnetic means.

4. The apparatus of claim 2 which comprises a plurality of said magnetic means.

5. The apparatus of claim 1 wherein said object inlet means comprises supply hopper means for storing elongated objects to be segregated; chute means for transporting elongated objects from said supply hopper means in a single file array to a supply means; supply means located at ther termination of said chute means for isolating the next single elongated object ot be picked up and held by said magnetic means; and pin means located on said disc, the number of said pin means being equal to the number of said magnetic means, whereby said supply means is mechanically responsive to the movement of said pin means as siad disc rotates so that the next elongated object is picked up and held by said magnetic means and the single elongated object nearest termination of said chute means moves into and is isolated by said supply means.

6. The apparatus of claim 5 which comprises a plurality of said magnetic means and wherein at least one of said removal means further comprises bottom means located below said disc and situated so as to come into contact with each said elongated object which passes as said disc rotates to remove the lower portion of each such elongated object from said magnetic means, whereby said elongated objects which simultaneously contact both said bottom means and said portion of said removal means located at a predetermined height above said disc are totally removed from said magnetic means.

7. The apparatus of claim 1 wherein the position of said leveling means is adjustable to vary in a predetermined manner the length below said disc of said elongated objects being held by said magnetic means.

8. A method of segregating elongated objects according to length which comprises utilizing the apparatus of claim 1.

9. A method of segregating elongated objects according to length which comprises utilizing the apparatus of claim 4.

10. A method of segregating elongated objects according to length which comprises utilizing the apparatus of claim 6.

11. An apparatus to segregate elongated objects according to length comprising:

a rotatable disc;

object inlet means located adjacent to the periphery of said disc to supply elongated objects to said disc, said object inlet means comprising supply hopper means for storing elongated objects to be segregated; chute means for transporting elongated objects from said supply hopper means in a single file array to a supply means; supply means located at the termination of said chute means for isolating the next single elongated object to be picked up and held by said magnetic means; and pin means located on said disc, the number of said pin means being equal to the number of the magnetic means, described hereinafter, whereby said supply means is mechanically responsive to the movement of said pin means as said disc rotatates so that the next elongated object is picked up and held by said magnetic means and the single elongated object nearest the termination of said chute means moves into and is isolated by said means;

at least one magnetic means at or near the periphery of said disc so that, as said disc rotates, said magnetic means picks up and holds at least one elongated object from said object inlet means, said magnetic means holding said elongated objects in a substantially vertical position relative to the rotation of said disc;

leveling means located below said disc to provide a substantially constant predetermined length below said disc of said elongated objects being held by said magnetic means as said disc rotates past said leveling means; and a plurality of exit means to remove and recover said elongated objects from said magnetic means as said disc rotates, each said exit means comprising removal means at least partially located at a predetermined height above said disc for removing said elongated objects from said magnetic means and a collection means for storing said elongated objects thus removed, provided that the predetermined height above said disc of each succeeding removal means decreases.

12. The apparatus of claim 11 which comprises a plurality of said magnetic means and wherein at least one of said removal means comprises (1) bottom means located below said disc and situated so as to come into contact witheach said elongated object which passes as said disc rotates to remove the lower portion of each such elongated object from said magnetic means; and (2) upper means located at a predetermined height above said disc to remove from said magnetic means the upper portion of each said elongated object which comes into contact with said upper means, whereby said elongated objects which simultaneously contact both said bottom means and said upper means are totally removed from said magnetic means.

13. The apparatus of claim 11 wherein the position of said leveling means is adjustable to vary in a predetermined manner the length below said disc of said elongated objects being held by said magnetic means.

* * * * *